United States Patent [19]

Estabrook et al.

[11] 4,436,531

[45] Mar. 13, 1984

[54] SYNTHESIS GAS FROM SLURRIES OF SOLID CARBONACEOUS FUELS

[75] Inventors: Lawrence E. Estabrook, Whittier, Calif.; Robert M. Suggitt, Wappingers Falls, N.Y.

[73] Assignee: Texaco Development Corporation, White Plains, N.Y.

[21] Appl. No.: 412,437

[22] Filed: Aug. 27, 1982

[51] Int. Cl.[3] ..... C10J 3/46

[52] U.S. Cl. ..... 48/197 R; 48/206; 48/DIG. 7; 252/373

[58] Field of Search ..... 48/197 R, 200, 201, 48/202, 206, 209, 210, DIG. 7; 252/373

[56] References Cited

U.S. PATENT DOCUMENTS

| | | | |
|---|---|---|---|
| 2,924,515 | 2/1960 | Chapman et al. | 252/373 |
| 2,942,959 | 6/1960 | Rees et al. | 48/197 R |
| 2,963,355 | 12/1960 | Dille et al. | 48/206 |
| 4,094,650 | 6/1978 | Koh et al. | 48/197 R |
| 4,277,365 | 7/1981 | Paull et al. | 48/197 R |

*Primary Examiner*—Peter F. Kratz

*Attorney, Agent, or Firm*—Robert A. Kulason; Robert Knox, Jr.; Albert Brent

[57] ABSTRACT

Synthesis gas, fuel gas, or reducing gas is produced by the noncatalytic partial oxidation of a slurry of ash-containing solid carbonaceous fuel in a liquid carrier with a free-oxygen containing gas in the free-flow reaction zone of a refractory lined gas generator at an autogenous temperature in the range of about 2350° F. to 2900° F. so that about 75 to 95 weight percent of the carbon in the fuel feed to the reaction zone is converted into carbon oxides. The hot effluent gas stream from the reaction zone containing entrained particulate carbon, unconverted solid carbonaceous fuel, and molten slag is passed through a free-flow radiant cooler where it is contacted by and provides the heat to vaporize an aqueous solution of catalyst consisting of alkali metal and/or alkaline earth metal compound in water. In the presence of the catalyst, $H_2O$ and at least a portion of the particulate carbon and the carbon in the unconverted solid carbonaceous fuel are reacted together at a controlled temperature to produce additional $H_2$ and $CO_x$. The hot effluent gas stream enters the radiant cooler at a temperature in the range of about 2800° F.–2300° F. and leaves at a temperature in the range of about 1350° F.–1600° F. Further, the molten slag in the effluent gas stream may be fluxed with the alkali metal and/or alkaline earth metal compound to facilitate separation of the slag from the effluent gas stream.

28 Claims, No Drawings

SYNTHESIS GAS FROM SLURRIES OF SOLID CARBONACEOUS FUELS

BACKGROUND OF THE INVENTION

This invention relates to the gasification of slurries of ash-containing solid carbonaceous fuel. More specifically, it relates to the catalytic gasification of the particulate carbon and the carbon in the unconverted portion of ash-containing solid carbonaceous fuel entrained in the raw effluent synthesis gas stream leaving a refractory lined free-flow gas generator for the noncatalytic partial oxidation of slurries of ash-containing solid carbonaceous fuel, such as slurries of coal dispersed in a liquid medium i.e., water, liquid hydrocarbonaceous fuel, and mixtures thereof.

As supplies of petroleum gradually diminish, coal which is America's most abundant form of fossil fuel will play an increasingly major role in providing for the nation's energy requirements. One ton of coal contains the same amount of energy as three to four barrels of crude oil. Accordingly, in the future it will become necessary to produce an increasing fraction of liquid and gaseous fuels from coal. The gas produced by this invention may be used with or without further processing and/or purification as a gaseous fuel or as feedstock for the catalytic synthesis of liquid fuels.

Synthesis gas, fuel gas, and reducing gas may be produced from coal by well known gasification processes. For example, coassigned U.S. Pat. Nos. 3,544,291 and 4,289,502 respectively relate to a process for the partial oxidation of slurries of coal, and to an apparatus for producing cleaned and cooled synthesis gas by the partial oxidation of solid carbonaceous fuel. No catalysts or slurries of solid carbonaceous fuels are used in the processes described in U.S. Pat. Nos. 3,988,123 and 4,060,397. U.S. Pat. No. 4,094,650 pertains to a process for producing a $CH_4$-containing gas in a fluidized bed of catalyst comprising a carbon-alkali metal reaction product. The catalytic material is transported into an uncooled reaction vessel where it is maintained in a fluidized bed by means of an upflowing mixture of steam and a portion of recycle product gas.

The normal residence time in a conventional free-flow refractory lined partial oxidation gas generator is in the range of about 1–5 seconds. With short dwell times a small amount of the solid fuel particles may pass unreacted through the reaction zone of the gas generator. Such short dwell times may be insufficient to allow the envelope of liquid carrier surrounding each solid fuel particle to vaporize, and for the gases to then contact and react with the carbon in the solid fuel particle. When this occurs, the combustion efficiency of the process is reduced; and, the cost of cleaning the raw synthesis gas to remove the unconverted particles of solid fuel is increased. This problem is reduced or eliminated by the subject process in which substantially all of the carbon in the ash-containing solid carbonaceous fuel may be converted into carbon oxides.

SUMMARY OF THE INVENTION

This is a continuous process for producing a stream of synthesis gas, fuel gas or reducing gas by the noncatalytic partial oxidation of a slurry of ash-containing solid carbonaceous fuel with a free-oxygen containing gas. The liquid carrier for the solid fuel slurry is selected from the group consisting of water, liquid hydrocarbon fuel, and mixtures thereof. An effluent gas stream is first produced by the partial oxidation of the slurry of ash-containing solid carbonaceous fuel in a free-flow noncatalytic refractory lined gas generator at a temperature in the range of about 2350° F. to 2900° F. and a pressure in the range of about 10 to 200 atmospheres. A temperature moderator such as $H_2O$ may be employed when the liquid carrier is a liquid hydrocarbon fuel.

The partial oxidation gas generator is operated so as to convert from about 75 to 95 wt. % of the carbon in the fuel feed to the reaction zone into carbon oxides. The hot effluent gas stream leaving the gas generator comprises $H_2$, CO, $CO_2$ and at least one gas from the group $H_2O$, $N_2$, $H_2S$, COS, $CH_4$, $NH_3$, A, HCl, and HCN. Further, entrained in the hot effluent gas stream leaving the reaction zone is the remaining unconverted portion of the ash-containing solid carbonaceous fuel, particulate carbon i.e. soot, and the non-combustible inorganic ash portion i.e. molten slag from the reacted portion of the solid carbonaceous fuel.

The hot effluent gas stream leaving the reaction zone of the gas generator, with or without removal of a portion of the entrained particulate matter and/or slag, is passed through the unobstructed vertical central passage of a free-flow radiant cooler where it is contacted by and provides the heat to vaporize a solution of catalyst consisting of alkali metal and/or alkaline earth metal compound in water. The yield of alkali metal and/or alkaline earth metal constituent (basis weight of entrained carbon) is in the range of about 5–50 wt. %. The mole ratio of $H_2O/C$ in the reactant stream is in the range of about 0.7 to 25.0, or more; such as about 1.0 to 2.0; say about 1.5 to 6.0. A tube-wall comprising pipes or coils through which cooling water is passed line inside walls of the radiant cooler for use in controlling the reduction of the temperature of the stream of hot effluent gas passing therethrough. The hot effluent gas stream enters the radiant cooler at a temperature in the range of about 2300° F. to 2800° F. and leaves at a temperature in the range of about 1350° F. to 1600° F., such as 1500° F.

As the catalyzed effluent gas stream passes through the unobstructed central passage of the radiant cooler, at least a portion i.e. about 50–100 weight percent and preferably all of the entrained particulate carbon and the carbon in the remaining unconverted portion of the ash-containing solid carbonaceous fuel are reacted with $H_2O$ in the effluent gas stream to produce additional $H_2+CO_x$. Simultaneously, fluxing of the ash and slag entrained in the effluent gas stream may take place with the alkali metal and/or alkaline earth metal compound in the radiation cooler so that liquid slag droplets may be converted to solid granules at a lower temperature. Removal of the slag from the effluent gas stream is thereby facilitated. Advantageously, a portion of the sensible heat in the stream of hot effluent gas is recovered by indirect heat exchange with the cooling water flowing through the tube-wall in the radiant cooling zone. By-product steam may be thereby produced.

DESCRIPTION OF THE INVENTION

The present invention pertains to a continuous process for the production of a stream of synthesis gas, fuel gas, or reducing gas from slurries of ash-containing solid carbonaceous fuels in a liquid carrier. The product gas may be used with or without further processing and/or purification by conventional methods, depending on the composition of the ash-containing solid carbonaceous fuel feed.

In the process, a hot effluent gas stream is made by the partial oxidation of the slurry of ash-containing solid carbonaceous fuel in a liquid carrier with a free-oxygen containing gas and in the presence of a temperature moderator.

A typical partial oxidation synthesis gas generator is shown in co-assigned U.S. Pat. No. 2,818,326. A burner is located in the top of the gas generator along the central vertical axis for introducing the feed streams. A suitable annulus-type burner is shown in co-assigned U.S. Pat. No. 2,928,460. The gas generator is a vertical cylindrical steel pressure vessel lined on the inside with a thermal refractory material.

The term ash-containing solid carbonaceous fuel includes coal, such as anthracite, bituminous, subbituminous; coke from coal; lignite; residue derived from coal liquefaction; oil shale; tar sands; petroleum coke; asphalt; pitch; particulate carbon (soot); concentrated sewer sludge; and mixtures thereof. The solid carbonaceous fuel may be ground to a particle size so that 100% passes through an ASTM E11-70 Sieve Designation Standard (SDS) 1.40 mm Alternative No. 14. Pumpable slurries of solid carbonaceous fuels may have a solids content in the range of about 25–70 wt. % such as 45–68 wt. %, depending on the characteristics of the fuel and the slurrying medium. The slurrying medium may be water, liquid hydrocarbon, or both.

The term liquid hydrocarbon, as used herein, is intended to include various materials, such as liquified petroleum gas, petroleum distillates and residues, gasoline, naphtha, kerosene, crude petroleum asphalt, gas oil, residual oil, tar-sand and shale oil, oil derived from coal, aromatic hydrocarbons (such as benzene, toluene, and xylene fractions), coal tar, cycle gas oil from fluid-catalytic-cracking operation, furfural extract of coker gas oil, and mixtures thereof. Also included within the definition of liquid hydrocarbons are oxygenated hydrocarbonaceous organic materials including carbohydrates, cellulosic materials, aldehydes, organic acids, alcohols, ketones, oxygenated fuel oil, waste liquid and by-products from chemical processes containing oxygenated hydrocarbonaceous organic materials, and mixtures thereof.

The use of a temperature moderator to moderate the temperature in the reaction zone of the gas generator depends in general on the carbon to hydrogen ratio of the feed stock and the oxygen content of the oxidant stream. Suitable temperature moderators include steam, water, $CO_2$-rich gas, liquid $CO_2$, recycle synthesis gas, a portion of the cooled clean exhaust gas from a gas turbine employed downstream in the process with or without admixture with air, by-product nitrogen from the air separation unit used to produce substantially pure oxygen, and mixtures of the aforesaid temperature moderators. Water serves as the carrier and the temperature moderator with feed slurries of water and solid carbonaceous fuel. However, steam may be the temperature moderator with slurries of liquid hydrocarbon fuels and solid carbonaceous fuel. Generally, a temperature moderator is used with liquid hydrocarbon fuels and with substantially pure oxygen. The temperature moderator may be introduced into the gas generator in admixture with either the solid carbonaceous fuel feed, the free-oxygen containing stream, or both. Alternatively, the temperature moderator may be introduced into the reaction zone of the gas generator by way of a separate conduit in the fuel burner. When $H_2O$ is introduced into the gas generator either as a temperature moderator, a slurrying medium, or both, the weight ratio of water to the solid carbon in the solid carbonaceous fuel plus liquid hydrocarbon fuel if any, is in the range of about 0.3 to 2.0 and preferably in the range of about 0.5 to 1.0.

The term free-oxygen containing gas, as used herein is intended to include air, oxygen-enriched air, i.e., greater than 21 mole % oxygen, and substantially pure oxygen, i.e., greater than 95 mole % oxygen, (the remainder comprising $N_2$ and rare gases). Free-oxygen containing gas may be introduced into the burner at a temperature in the range of about ambient to 1200° F. The atomic ratio of free-oxygen in the oxidant to carbon in the feed stock (O/C, atom/atom) is preferably in the range of about 0.7 to 1.5, such as about 0.80 to 1.2.

The relative proportions of solid carbonaceous fuel, liquid hydrocarbon fuel if any, water or other temperature moderator, and oxygen in the feed streams to gas generator, are carefully regulated to convert a substantial portion of the carbon in the fuel feed to the partial oxidation gas generator e.g. 75 to 95 wt. %, such as 80 to 90 wt. % of the carbon to carbon oxides e.g. CO and $CO_2$ and to maintain an autogenous reaction zone temperature in the range of about 2350° to 2900° F. Advantageously, with ash-containing solid carbonaceous slurry feeds, the ash in the solid carbonaceous fuel forms molten slag at such reaction temperatures. Molten slag is much easier to separate from the hot effluent gas than fly-ash. Further, the hot effluent gas leaves the reaction zone at the proper temperature and pressure for the next step in the process. The pressure in the reaction zone is in the range of about 10 to 200 atmospheres. The time in the reaction zone of the partial oxidation gas generator in seconds is in the range of about 0.5 to 10, such as normally about 1.0 to 5.

The effluent gas stream leaving the partial oxidation gas generator has the following composition in mole % depending on the amount and composition of the feed-streams: $H_2$ 8.0 to 60.0, CO 8.0 to 70.0, $CO_2$ 1.0 to 50.0, $H_2O$ 2.0 to 50.0, $CH_4$0.0 to 2.0, $H_2S$ 0.0 to 2.0, COS 0.0 to 1.0, $N_2$ 0.0 to 80.0, and A 0.0 to 2.0. Trace amounts of the following gaseous impurities may be also present in the effluent gas stream in parts per million (ppm): HCN 0 to 100; such as about 2 to 20; HCl 0 to about 20,000, such as about 200 to 2,000; and $NH_3$ 0 to about 10,000, such as about 100 to 1000. Entrained in the effluent gas stream is about 0.5 to 20 wt. %, such as 1 to 4 wt. % of particulate carbon (basis weight of carbon in the feed to the gas generator) and the remaining portion of the unconverted ash-containing solid carbonaceous fuel feed. Molten slag resulting from the fusion of the ash content of the coal is also entrained in the gas stream leaving the generator.

The effluent gas stream leaving the reaction zone of partial oxidation gas generator at a temperature in the range of about 2350° F. to 2900° F. is passed through a radiant cooler where it is contacted with a spray of catalyst solution consisting of alkali metal and/or alkaline earth metal compound in water. The radiant cooler is preferably connected directly in succession to the discharge outlet of the reaction zone of the gas generator, such as shown and described in coassigned U.S. Pat. No. 3,551,347, and in U.S. Pat. No. 4,309,196, which are incorporated herein by reference. This sequence is also shown in German Pat. No. 2,650,512. The effluent gas stream from the gas generator may be passed in a downward or upward direction through the radiant cooler.

Alternatively, a portion of the combustion residue entrained in the effluent gas stream leaving the reaction zone may be removed prior to the radiant cooler. This may be done with substantially no reduction in temperature of the effluent gas stream by gravity and/or gas-solids separation means, such as cyclone or impingement separators. Refractory-lined first and/or second slag and residue separation chambers may be connected in between the discharge outlet of the reaction zone of the gas generator and the inlet to the radiation cooler for separation of a portion of the entrained matter by gravity. This mode is shown and described in coassigned U.S. Pat. No. 4,251,228, which is incorporated herein by reference.

Any suitable radiant cooler such as those previously mentioned, may be used in the subject process. The radiant cooler essentially comprises an elongated cylindrically shaped vertical pressure vessel. The steel walls of the vessel are lined on the inside with a tube-wall which extends through the full length of the vessel. A coolant such as cooling water or water and steam flows through the individual tubes of the tube-wall. By this means the outer shell of the radiant cooler is protected against the hot gas stream flowing freely through the unobstructed longitudinal central passage of the vessel which is surrounded by said tube-wall. The tube-wall comprises a plurality of adjacent contacting rows of vertical tubes or coils in a concentric ring that is radially spaced from the central longitudinal axis of the vessel.

In one embodiment, a plurality of thin-walled vertical tubes with or without side fins line the inside walls of the radiant cooler. The adjacent rows of tubes are longitudinally welded together to make an annular gas-tight wall of tubes. The lower and upper ends of each said tubes may be respectively connected to lower and upper annular shaped headers. When the coolant in the tube-wall is water or a mixture of water and steam, the highest temperature that the pressure shell can reach is the temperature of the saturated steam within the radiant cooler. Boiler feed water is introduced into the bottom header and then passes up through the plurality of separate upright tubes into the top header. The mixture of steam and water is removed from the top header and introduced into an external steam drum where separation takes place. The saturated steam removed from the steam drum may be used elsewhere in the process to provide heat or power. Optionally, at least a portion of the saturated steam may be superheated. The hot water separated in the steam drum may be returned to the bottom header of the radiant cooler. Optionally, for cleaning and maintenance, a plurality of nozzles may be secured on the outside of the tube-wall. By this means, a stream of water, steam or air may be directed against the tube-wall. Thus, the tube-wall may be washed down with water, and any alkali metal and/or alkaline earth metal compound deposited thereon may be removed by the wash water and recovered for reuse in a tank below.

The hot effluent gas stream may enter through either end of the vertical radiant cooler and freely flow through the unobstructed central core. The temperature of the hot effluent gas stream is steadily reduced as it flows through the radiant cooler. By radiation and convection, a portion of the sensible heat in the hot effluent gas stream is absorbed by indirect heat exchange with the cooling water and steam flowing inside of the tube-wall. The temperature of the gas stream is primarily controlled by this means.

The aqueous solution of catalyst is sprayed into the effluent gas stream in the radiant cooler by means of spray nozzles or atomizers. Any suitable number and arrangement of spray nozzles, atomizers, or other suitable mixing means may be employed which provide intimate contacting and mixing of the aqueous catalyst solution with the hot effluent gas stream within the radiation cooler. For example, at least one spray nozzle may be located within the radiant cooler and downstream from the entrance so that the entering hot effluent gas stream may be immediately contacted by the atomized spray of aqueous solution of catalyst. When required additional spray nozzles for spraying catalyst solution may be longitudinally spaced along the central passageway or central longitudinal axis of the radiant cooler.

The preferred aqueous solution of catalyst is prepared by dissolving at least one water-soluble alkali metal salt or hydroxide in water to produce a solution containing alkali metal compound in the amount of about 10 wt. % to saturation. Alternatively, the aqueous solution of catalyst may contain at least one water-soluble alkaline earth metal salt or hydroxide in the amount of about 10 wt. % to saturation.

Still again, the aqueous solution of catalyst may contain mixtures of at least one water-soluble alkali metal salt or hydroxide and at least one alkaline earth metal salt or hydroxide in the amount of about 10 wt. % to saturation.

Alkali metal constituents from Group IA of the Periodic Table of Elements, such as cesium, potassium, sodium and lithium in that order are generally most effective. Potassium and sodium compounds such as $K_2CO_3$ and $Na_2CO_3$ or mixtures thereof are most effective for their cost.

Alkaline earth metal constituents from Group IIA, of the Periodic Table of Elements such as barium, strontium, calcium, and magnesium, in that order are generally most effective. $CaCO_3$ is most effective for its cost.

Water soluble compounds of Groups IA and/or Group IIA which are suitable for practicing the subject invention include the carbonates, bicarbonates, hydroxides, silicates, sulfates, sulfites, aluminates, and borates. Hydrates of said compounds, and suitable waste products rich in aforesaid compounds may also be used. The alkali metal and/or alkaline earth metal halides are less preferred and generally should be avoided to avoid halide corrosion of stainless steel or other ferro-alloys in subsequent processing equipment, e.g., in the quench and purification systems.

The aqueous solution of alkali metal and/or alkaline earth metal compound at a temperature in the range of about ambient to 200° F. is introduced into the radiant cooler at a rate and concentration so that after the water solvent vaporizes the yield of the alkali metal and/or alkaline earth metal constituent that becomes intimately associated with the particulate carbon and the carbon in the unconverted solid carbonaceous fuel entrained in the effluent gas passing through the radiant cooler is in the range of about 5–50 wt. %, such as 10–20 wt. % (basis wt. of entrained carbon). Further, immediately after being contacted by the aqueous solution of catalyst in the radiant cooler, the mole ratio $H_2O/C$ in the hot gas stream is in the range of about 0.7 to 25.0, or more; such as in the range of about 1.0 to 20.0; say about 1.5 to 6.0.

The dwell time of the hot gas stream passing through the radiant cooler is in the range of about 5 to 50 seconds, such as about 15 to 40 seconds.

In the preferred embodiment, the gas stream enters the radiant cooler at substantially the same temperature as that which it had when it left the reaction zone of the partial oxidation gas generator i.e. about 2350° F. to 2900° F., less any ordinary drop in the lines i.e. about 50°-100° F. temperature drop. The partially cooled gas stream leaves at the opposite end of the radiant cooler after its temperature has been steadily reduced to a temperature in the range of about 1350° F.-1600° F., such as 1500° F. The pressure of the gas stream in the radiant cooler is substantially the same as that in the gas generator, less ordinary pressure drop in the lines i.e. about 1-2 atmospheres pressure drop. At these temperatures and pressures, the catalytic reactions between carbon and steam to produce additional hydrogen and carbon monoxide are favored in comparison with the catalytic methanation reaction. At least a portion i.e. about 50-100 wt. % and preferably all of the carbon in the remaining unconverted portion of the ash-containing solid carbonaceous fuel and the entrained particulate carbon are reacted with $H_2O$ in the effluent gas stream to produce additional $CO+H_2$. By this process, the $H_2+CO_x$ content in the gas stream is increased by an amount in the range of about 5 to 40 mole %, such as about 10 to 20 mole %. The term $CO_x$ represents $CO+CO_2$.

In another embodiment of the subject process, the methane concentration of the gas stream is increased to a range of about 3 to 15 mole percent by first converting only a portion of the available carbon entrained in the effluent gas stream by the catalytic steam-carbon reaction, followed by the conversion of the remainder of the unconverted carbon by a catalytic methanation reaction at a lower temperature. The catalytic steam-carbon reaction takes place in the front section of the radiant cooler at comparatively high temperatures and under the conditions described previously for the preferred embodiment. The catalytic methanation reaction follows at the cooler end of the radiant cooler at comparatively lower temperatures in the range of about 1300° F. to 900° F. Such lower temperatures favor the formation of methane.

Thus, in this second embodiment the effluent gas stream from the reaction zone of the partial oxidation gasifier enters the radiant cooler at a temperature in the range of about 2300° F. to 2800° F. Different reactions take place in two consecutive stages or sections of the radiant cooler in tandem. However, in both sections of the gas cooler the addition of catalyst and the $H_2O/C$ mole ratio are substantially the same as described previously for the preferred embodiment. In the first stage, for a given flow rate, the temperature of the gas stream passing through the first section of the radiant cooler is primarily controlled by indirect heat exchange with cooling water or water and steam in the tube-wall. Further, by the time that about 50-75 weight percent of the entrained particulate carbon and the carbon in the unconverted portion of the ash-containing solid carbonaceous fuel have been reacted with $H_2O$ in the effluent gas stream to produce additional $H_2$ and $CO_x$, the temperature of the gas stream has been simultaneously and steadily reduced to a value in the range of about 1300° F.-1350° F. At about this point, the second stage begins and additional catalyst solution consisting of alkali metal and/or alkaline earth metal compound in water may be optionally introduced into the radiant cooler in the manner previously described, and may contact the effluent gas stream at said reduced temperature. $H_2O$, $CO$, $CO_2$, $H_2$ and the remaining portions of unconverted particulate carbon and carbon in the ash-containing solid carbonaceous fuel entrained in the catalyzed effluent gas stream are reacted together in the second stage to produce additional $CH_4$. This methanation reaction continues as the catalyzed gas stream passes through the second section of the radiant cooler and simultaneously while its temperature is being steadily reduced primarily by indirect heat exchange with the cooling water or water and steam in the tube-wall until a discharge temperature in the range of about 900° F.-1000° F. is reached.

Advantageously, useful thermal energy may be recovered from the exothermic catalytic methanation reaction by indirect heat exchange between the gas stream flowing down the central passageway of the radiant cooler and the cooling water flowing through the tube-wall. By this means, by-product steam may be produced.

At least a portion of the molten slag entrained in the hot gas stream in the radiant cooler is fluxed with the alkali metal and/or alkaline earth metal compound. A material with greater fluidity and having a lower melting point is thereby produced. By extending the dwell time of the catalyzed gas stream in the radiant cooler in order to cool the molten fluxed slag to the lower solidification temperature, the amount of carbon converted may be increased.

Preferably, the temperature of the gas stream departing from the radiant cooler is lower than the melting point of the fluxed slag. The molten fluxed slag is thereby converted into granules which drop by gravity into a water bath contained in a slag chamber below. A suitable apparatus for doing this is shown in FIG. 1 of the drawing for coassigned U.S. Pat. No. 4,251,228, which is incorporated herein by reference.

The comparatively clean and partially cooled gas stream leaves the downstream end of the radiant cooler at a temperature below the maximum safe operating temperature for downstream devices used to recover energy from the hot gas stream such as a conventional convection type gas cooler, an expansion turbine for the production of mechanical or electrical energy, or both. For example, the gas stream may leave a downstream convection-type gas cooler or exit from some other energy utilizing means at a temperature in the range of about 150° to 600° F. The gas stream may be then optionally subjected to additional process steps including gas scrubbing, water-gas shift or methanation reactions, and purification, depending on its intended use as a synthesis gas, reducing gas, or fuel gas.

For example, the partially cooled gas stream discharged from the radiant cooler may be passed through a convection-type cooler and cooled to a temperature in the range of about 150° to 600° F. by indirect heat exchange with boiler feed water (BFW). The BFW is thereby converted into by-product steam. A portion of the steam may be recycled to the gas generator for use as the temperature moderator. The remainder of the steam may be exported. Alternatively, the partially cooled gas stream from the radiant cooler may be passed through an expansion turbine. The gas stream leaving the convection-type gas cooler or that which is discharged from said expansion turbine may be then cleaned substantially free of any remaining entrained particulate matter. For example, any carbon soot, slag and catalyst in the gas stream may be removed by scrubbing the gas stream with water in a gas scrubber. Substantially, all the remaining water soluble catalyst dissolves in the stream of scrubbing water. Further, substantially all of the remaining water insoluble particulate matter which is scrubbed from the gas stream is also contained in said stream of scrubbing water. The clean gas stream may be separated from the stream of scrubbing water in a conventional separating vessel. Optionally, a portion of the catalyst may be recovered from the scrubbing water by conventional procedures and recycled to the radiant cooler in admixture with a solution of make-up catalyst.

An added benefit of the subject process is the simultaneous removal of all of unwanted free gaseous impurities selected from the group consisting of HCN, HCl, COS and mixtures thereof in the catalyzed gas stream while the gas stream is passing through the radiant cooler. Thus, by the hydrolysis of hydrogen cyanide in the presence of the catalyst, ammonia and a water-soluble alkali metal and/or an alkaline earth metal formate may be formed. Further, by the partial hydrolysis of carbonyl sulfide in the presence of the catalyst, carbon dioxide and hydrogen sulfide may be produced. Also, any free hydrogen chloride in the gas stream may be neutralized by reaction with the a portion of the base catalyst to produce a water-soluble salt. These salts are easily removed from the gas stream along with any remaining particulate matter and catalyst by scrubbing the gas stream with water in the gas scrubber located downstream in the process in the manner previously described.

The advantages achieved by the subject process in which the solution of catalyst is introduced directly into the radiant cooler, rather than elsewhere, such as in admixture with the feed to the partial oxidation gas generator include the following:

(1). The sensible heat in the effluent gas stream from the partial oxidation gas generator may be efficiently used at high temperatures to provide the necessary energy to initiate and to carry out the endothermic steam-carbon reaction.

(2). The residence time in the partial oxidation gas generator may be reduced. This will result in shorter and less costly gas generators.

(3). The thermal refractory lining of the gas generator is not subject to attack by contact with an alkali metal and/or alkaline earth metal compound.

(4). Low grade solid fuels may be used as feed to the partial oxidation gas generator, without costly upgrading.

(5). The catalyst solution is intimately mixed with the entrained matter in the hot gas stream in the radiant cooler. When the liquid solvent vaporizes, nascent uncontaminated catalyst is released at an elevated temperature and is intimately mixed with and contacts the particulate carbon, carbon in the solid carbonaceous fuel, and the molten slag. Simultaneously, supplemental $H_2O$ may be introduced. The conversion rate for the steam-carbon reaction is thereby increased.

(6). Separation of the molten slag entrained in the effluent gas stream passing through the radiant cooler may be facilitated. A portion of the catalyst will react with clay materials in the molten slag to form, for example, insoluble potassium aluminosilicates. The melting point of the slag is thereby lowered and its fluidity is increased. The fluxed slag will more easily settle in the pool of water at the bottom of the slag chamber.

(7). Very little, if any unconverted carbon remains. Gas cleaning costs are thereby substantially reduced. The desirable steam-carbon reaction produces 2 moles of synthesis gas for each mole of carbon in contrast to one mole of synthesis gas from the partial oxidation of carbon. The amount of product gas produced from a specific amount of solid carbonaceous fuel is thereby increased.

(8). Alkali metal and/or alkaline earth metal compounds that deposit on the tube-wall of the radiant cooler will aid in the tube cleaning process when the outside surfaces of the tubes are washed down with water.

(9). The gas stream passing through the radiant cooler is simultaneously purified. Free unwanted gaseous impurities from the group consisting of HCN, HCl, COS and mixtures thereof are removed.

(10). There is a reduction in the amount of oxygen consumed in the gas generator. This results in a substantial economic savings.

Other modifications and variations of the invention as hereinbefore set forth may be made without departing from the spirit and scope thereof, and therefore only such limitations should be imposed on the invention as are indicated in the appended claims.

We claim:

1. A continuous process for the production of synthesis gas, fuel gas, or reducing gas from a slurry of an ash-containing solid carbonaceous fuel comprising, (1) reacting about 75 to 95 weight percent of the carbon in said slurry of ash-containing solid carbonaceous fuel by noncatalytic partial oxidation with a free-oxygen containing gas and in the presence of a temperature moderator in the free-flow refractory lined reaction zone of a gas generator at an autogenous temperature in the range of about 2350° F. to 2900° F. and a pressure in a range of about 10 to 200 atmospheres to produce a hot stream of gas comprising $H_2$, CO, $CO_2$, and at least one material selected from the group consisting of $H_2$, $N_2$, $H_2S$, COS, $CH_4$, $NH_3$, A, HCl, HCN, and containing entrained matter comprising particulate carbon, the remainder of the unconverted ash-containing solid carbonaceous fuel, and molten slag;

(2) passing the hot gas stream into a gas cooling zone including a radiant cooler provided with an unobstructed central passage through which the hot gas stream is passed; contacting said hot gas stream within said cooling zone with an aqueous solution of catalyst consisting of a water soluble alkali metal compound and/or an alkaline earth metal compound and water, wherein the alkali metal and/or the alkaline earth metal constituents of the compound are selected from the metals in the Periodic Table of Elements in Groups IA and/or IIA; and intimately mixing said catalyst solution with said entrained matter and vaporizing the water;

(3) reacting in said gas cooling zone in the presence of said catalyst $H_2O$ and at least a portion of the particulate carbon and the carbon in the remainder of the unconverted ash-containing solid carbonaceous fuel entrained in said gas stream; and simultaneously reducing the temperature of said gas stream from an entering temperature in the range of about 2300° F. - 2800° F. to a discharge temperature in the range of about 1350° F. - 1600° F. by indirect heat exchange with a coolant; and (4) discharging from said gas cooling zone a partially cooled gas stream containing an increased amount of $H_2+CO_x$.

2. The process of claim 1 wherein the central passage of said radiant cooler is surrounded by a tube-wall through which cooling water is passed to provide said cooling of the hot gas stream passing therethrough, and the contacting in (2) takes place by contacting the hot gas stream passing through the central passage of said radiant cooler with an atomized spray of said aqueous solution of catalyst.

3. The process of claim 1 provided with the steps of fluxing at least a portion of said molten slag in the gas stream passing through the cooling zone in (3) with a portion of said alkali metal compound and/or alkaline earth metal compound to produce a material of greater fluidity and having a lower melting point, cooling said material below its melting point to form granules, and separating said granules from the gas stream by gravity.

4. A continuous process for the production of synthesis gas, fuel gas, or reducing gas from a slurry of an ash-containing solid carbonaceous fuel comprising, (1) reacting about 75 to 95 weight percent of the carbon in said slurry of ash-containing solid carbonaceous fuel by noncatalytic partial oxidation with a free-oxygen containing gas and in the presence of a temperature moderator in the free-flow refractory lined reaction zone of a gas generator at an autogenous temperature in the range of about 2350° F. to 2900° F. and a pressure in a range of about 10 to 200 atmospheres to produce a hot stream of gas comprising $H_2$, CO, $CO_2$, and at least one material selected from the group consisting of $H_2O$, $N_2$, $H_2S$, COS, $CH_4$, $NH_3$, A, HCl, HCN, and containing entrained matter comprising particulate carbon, the remainder of the unconverted ash-containing solid carbonaceous fuel, and molten slag;

(2) passing the hot gas stream into a gas cooling zone including a radiant cooler provided with an unobstructed central passage through which the hot gas stream is passed, the cooling zone comprising two consecutive sections in tandem; contacting said hot gas stream within the first section of said cooling zone with an aqueous solution of catalyst consisting of a water soluble alkali metal compound and/or an alkaline earth metal compound and water, wherein the alkali metal and/or the alkaline earth metal constituents of the compound are selected from the metals in the Periodic Table of Elements in Groups IA and/or IIA; and intimately mixing said catalyst solution with said entrained matter and vaporizing the water;

(3) reacting in the first section of said gas cooling zone in the presence of said catalyst $H_2$ and a portion of the particulate carbon and the carbon in the remainder of the unconverted ash-containing solid carbonaceous fuel entrained in said gas stream; and simultaneously reducing the temperature of said gas stream passing through said first section of the gas cooling zone from an entering temperature in the range of about 2300° F. -2800° F. to a temperature in the range of about 1300° F. -1350° F. by indirect heat exchange with a coolant; wherein the $H_2+CO_x$ content of the gas stream is increased;

(4) passing the gas stream from (3) into the second section of said gas cooling zone, and with or without contacting the gas stream with additional aqueous solution of said catalyst reacting $H_2O$, CO, $CO_2$, $H_2$ and the remaining portions of unconverted particulate carbon and carbon in the ash-containing solid carbonaceous fuel entrained in the catalyzed gas stream; and simultaneously reducing the temperature of the gas stream passing through said second section of the gas cooling zone from a temperature in the range of about 1300° F.-1350° F. to a discharge temperature in the range of about 900° F.-1000° F. by indirect heat exchange with a coolant; and (5) discharging the partially cooled gas stream from the second section of said gas cooling zone containing an increased amount of $CH_4$.

5. The process of claims 1 or 4 wherein said aqueous solution of catalyst consists of from about 10 weight % to saturation of a water soluble alkali metal and/or alkaline earth metal compound selected from the group of compounds consisting of carbonates, bicarbonates, hydroxides, silicates, sulfate, sulfites, aluminates, and borates, and mixtures thereof; and wherein said alkali metal constituents are selected from the group consisting of K, Na, Li, and mixtures thereof, and/or said alkaline earth metal constituents are selected from the group consisting of Ba, Ca, Mg, and mixtures thereof.

6. The process of claim 5 wherein said compounds are hydrates, or provided by suitable waste products rich in said compounds.

7. The process of claims 1 or 4 wherein said aqueous solution of catalyst consists of the salts or hydroxides of a metal selected from the group of metals consisting of K, Na, Ca, and mixtures thereof, in water.

8. The process of claims 1 or 4 wherein said aqueous solution of catalyst consists of from about 10 weight % to saturation of $Na_2CO_3$, $K_2CO_3$, and mixtures thereof, in water.

9. The process of claims 1 or 4 wherein the dwell times in the partial oxidation gas generator in (1) and in the gas cooling zone in (2) are respectively in the ranges of about 0.5–10 seconds and about 5 to 50 seconds.

10. The process of claims 1 or 4 where immediately after being contacted by the aqueous solution of catalyst in said gas cooling zone, the mole ratio $H_2O/C$ of the hot gas stream is in the range of about 0.7 to 25.0, or more.

11. The process of claims 1 or 4 wherein the hot stream of gas leaving the gas generator in (1) is introduced into the gas cooling zone in (2) with substantially no change in temperature and pressure, except for ordinary losses of temperature and pressure in the lines.

12. The process of claims 1 or 4 wherein at least a portion of the entrained matter in the hot gas stream leaving the gas generator in (1) is removed by gravity and/or gas-solids separation means prior to introducing the hot gas stream into the gas cooling zone in (2).

13. The process of claims 1 or 4 wherein the yield of alkali metal and/or alkaline earth metal constituent that is intimately associated with the particulate carbon and the carbon in the remaining unconverted ash-containing solid carbonaceous fuel is in the range of about 5–50 wt. % (basis weight of entrained carbon).

14. The process of claims 1 or 4 wherein said ash-containing solid carbonaceous fuel is selected from the group consisting of coal, coke from coal; lignite; residue derived from coal liquefaction; oil shale; tar sands; petroleum coke; asphalt; pitch; particulate carbon (soot); concentrated sewer sludge; and mixtures thereof.

15. The process of claims 1 or 4 wherein said solid carbonaceous fuel is introduced into the reaction zone of the partial oxidation gas generator in admixture with a liquid carrier selected from the group consisting of water, liquid hydrocarbon fuel, and mixtures thereof.

16. The process of claims 1 or 4 in which said temperature moderator is selected from the group consisting of steam, water, $CO_2$-rich gas, liquid $CO_2$, $N_2$, recycle synthesis gas, exhaust gas from a turbine, and mixtures thereof.

17. The process of claims 1 or 4 in which said free-oxygen containing gas is selected from the group consisting of air, oxygen-enriched air, i.e. greater than 21 mole % $O_2$, and substantially pure oxygen, i.e. greater than about 95 mole % $O_2$.

18. The process of claim 4 wherein the central passage of said radiant cooler is surrounded by a tube-wall through which cooling water is passed to provide said cooling of the hot gas stream passing therethrough, and the contacting in (2) and optionally in (4) takes place by contacting the hot gas stream passing through the central passage of said radiant cooler with an atomized spray of said aqueous solution of catalyst.

19. The process of claim 4 provided with the steps of fluxing at least a portion of said molten slag in the gas stream passing through said gas cooling zone with a portion of said alkali metal compound and/or alkaline earth metal compound to produce a material of greater fluidity and having a lower melting point, cooling said material below its melting point to form granules, and separating said granules from the gas stream of gravity.

20. The process of claims 1 or 4 wherein said coolant is water or a mixture of water and steam, and by-product steam is produced by said indirect heat exchange.

21. The process of claims 1 or 4 provided with the steps of passing the partially cooled gas stream discharged from the gas cooling zone through a convection-type gas cooler in the indirect heat exchange with cooling water or through an expansion turbine; and then scrubbing the gas stream with water in a gas scrubbing zone and producing a clean gas stream and a separate stream of scrubbing water in which substantially all of any remaining water soluble catalyst scrubbed from said gas stream is dissolved and which contains substantially all of the remaining water insoluble particulate matter scrubbed from said gas stream.

22. The process of claim 21 provided with the steps of recovering a portion of the catalyst compound from said scrubbing water and recycling said catalyst compound to said gas cooling zone in admixture with a solution of make-up catalyst.

23. The process of claims 1 or 4 provided with the steps of reacting substantially all of the free HCl in the hot gas stream passing through the gas cooling zone with a portion of water soluble catalyst consisting of an alkali metal compound and/or alkaline earth metal compound to produce a water soluble salt; passing the partially cooled gas stream discharged from the cooling zone through a convection-type gas cooler in indirect heat exchange with cooling water or through an expansion turbine; and then scrubbing the gas stream with water in a gas scrubbing zone and producing a clean gas stream and the separate stream of scrubbing water in which substantially all of said water soluble salt and any remaining water soluble catalyst scrubbed from said gas stream are dissolved, and which contains substantially all of the remaining water insoluble particulate matter scrubbed from said gas stream.

24. The process of claim 23 provided with the steps of recovering a portion of the water soluble catalyst from said separate stream of scrubbing water, and recycling said recovered catalyst to the gas cooling zone in admixture with a solution of make-up catalyst.

25. The process of claims 1 or 4 provided with the steps of reacting together $H_2O$ and substantially all of the COS in the hot gas stream passing through the gas cooling zone in the presence of said catalyst compound to produce $CO_2$ and $H_2S$; passing the partially cooled gas stream discharged from the cooling zone through a convection-type gas cooler in indirect heat exchange with cooling water or through an expansion turbine; and then scrubbing the gas stream with water in a gas scrubbing zone and producing a clean gas stream and a separate stream of scrubbing water in which substantially all of any remaining water soluble catalyst scrubbed from said gas stream is dissolved, and in which contains substantially all of the remaining water insoluble particulate matter scrubbed from said gas stream.

26. The process of claim 25 provided with the steps of recovering a portion of the catalyst compound from said separate stream of scrubbing water, and recycling said catalyst compound to said gas cooling zone in admixture with a solution of make-up catalyst.

27. The process of claims 1 or 4 provided with the steps of reacting together $H_2O$ and substantially all of the free HCN in the hot gas stream passing through the gas cooling zone in the presence of said catalyst compound to produce ammonia and water soluble formate(s) of alkali metal and/or alkaline earth metal; passing the partially cooled gas stream discharged from the cooling zone through a convection-type gas cooler in indirect heat exchange with cooling water or through an expansion turbine; and then scrubbing the gas stream with water in a gas scrubbing zone and producing a clean gas stream and a separate stream of scrubbing water in which substantially all of said water soluble formate(s) and any remaining water soluble catalyst scrubbed from said gas stream are dissolved, and which contains substantially all of the remaining water insoluble particulate matter scrubbed from said gas stream.

28. The process of claim 27 provided with the steps of recovering a portion of the catalyst compound from said separate stream of scrubbing water, and recycling said catalyst compound to said gas cooling zone in admixture with a solution of make-up catalyst.

* * * * *

UNITED STATES PATENT AND TRADEMARK OFFICE

CERTIFICATE OF CORRECTION

PATENT NO. : 4,436,531

DATED : March 13, 1984

INVENTOR(S) : L. E. ESTABROOK, R. M. SUGGITT

It is certified that error appears in the above—identified patent and that said Letters Patent is hereby corrected as shown below:

In Claim 4
Column 11, line 56 Change "$H_2$" to --$H_2O$--

Signed and Sealed this

*Sixth* Day of *November 1984*

[SEAL]

*Attest:*

GERALD J. MOSSINGHOFF

*Attesting Officer*

*Commissioner of Patents and Trademarks*